US009907420B2

(12) United States Patent
Fellin et al.

(10) Patent No.: US 9,907,420 B2
(45) Date of Patent: Mar. 6, 2018

(54) FOOD POUCH CONTAINER

(71) Applicants: Jennifer Fellin, Manhattan Beach, CA (US); Timothy Fellin, Manhattan Beach, CA (US)

(72) Inventors: Jennifer Fellin, Manhattan Beach, CA (US); Timothy Fellin, Manhattan Beach, CA (US)

( * ) Notice: Subject to any disclaimer, the term of this patent is extended or adjusted under 35 U.S.C. 154(b) by 0 days.

(21) Appl. No.: 14/340,547

(22) Filed: Jul. 24, 2014

(65) Prior Publication Data

US 2015/0203248 A1 Jul. 23, 2015

Related U.S. Application Data

(60) Provisional application No. 61/929,206, filed on Jan. 20, 2014.

(51) Int. Cl.

| | |
|---|---|
| ***B65D 25/00*** | (2006.01) |
| ***A47G 23/00*** | (2006.01) |
| ***B65D 77/06*** | (2006.01) |
| ***A47G 21/00*** | (2006.01) |
| ***B65D 6/00*** | (2006.01) |
| ***B65D 25/04*** | (2006.01) |
| ***B65D 25/10*** | (2006.01) |
| ***B65D 83/00*** | (2006.01) |

(52) U.S. Cl.

CPC ..... *A47G 23/00* (2013.01); *A47G 21/00* (2013.01); *A47G 21/001* (2013.01); *B65D 11/20* (2013.01); *B65D 25/04* (2013.01); *B65D 25/10* (2013.01); *B65D 77/06* (2013.01); *B65D 77/065* (2013.01); *B65D 83/0011* (2013.01); *B65D 2209/00* (2013.01)

(58) Field of Classification Search

CPC .... B65D 25/38; B65D 11/20; B65D 83/0011; B65D 77/06; B65D 25/10; B65D 25/04; B65D 77/065; B65D 2209/00; A47G 23/00; A47G 21/001; A47G 21/00

USPC ..... 222/105, 556, 103, 95, 183; 220/495.03, 220/495.06, 737, 23.87, 4.22

See application file for complete search history.

(56) References Cited

U.S. PATENT DOCUMENTS

| | | | |
|---|---|---|---|
| 2,558,124 | A | 6/1951 | Burden |
| 2,864,367 | A | 12/1958 | Mende |
| 4,890,741 | A | 1/1990 | Edelstein |
| 5,337,924 | A | 8/1994 | Dickie |

(Continued)

OTHER PUBLICATIONS

Print out from www.amazon.com; Fisher-Price Tote Along Pouch; date unknown, at least Jul. 24, 2013 (oldest review).

Print out from www.amazon.com; EasyPouch Independence; date unknown, at least Mar. 14, 2014 (oldest review).

Notice of Allowance issued by the United States Patent and Trademark Office in U.S. Appl. No. 14/340,778 dated Apr. 23, 2015.

*Primary Examiner* — Kareen Thomas

(74) *Attorney, Agent, or Firm* — David A. Belasco; Belasco Jacobs & Townsley, LLP

(57) ABSTRACT

Disclosed herein are food pouch containers comprising a back portion having an interior cavity; a front portion; a top hole; and a surface dividing the back portion into an upper cavity, inside the back portion, and a lower cavity. In some embodiments, the lower cavity is inside the back portion, while in other embodiments, the lower cavity is an exterior cavity. Also disclosed are food pouch containers comprising a back portion having an interior cavity; a front portion; a top hole; means for contouring the food pouch from a bottom thereof; and means for contouring the food pouch from at least a side thereof.

17 Claims, 14 Drawing Sheets

(56) References Cited

U.S. PATENT DOCUMENTS

| | | | | |
|---|---|---|---|---|
| 5,377,869 | A | 1/1995 | Weiss et al. | |
| 5,474,212 | A | 12/1995 | Ichikawa et al. | |
| 5,730,327 | A | 3/1998 | Stern | |
| 6,076,698 | A | 6/2000 | Magidson | |
| 6,142,344 | A | 11/2000 | Kai | |
| 6,510,965 | B1 | 1/2003 | Decottignies et al. | |
| 6,574,985 | B2 | 6/2003 | Fiore, Jr. | |
| 6,619,505 | B1 | 9/2003 | Decottignies et al. | |
| 8,251,075 | B2 * | 8/2012 | Breese | A45D 34/04 132/299 |
| 8,430,262 | B2 | 4/2013 | Corbett et al. | |
| 8,663,419 | B2 * | 3/2014 | Corbett | B65D 11/02 156/242 |
| 8,714,407 | B2 | 5/2014 | Frank et al. | |
| 9,101,948 | B2 * | 8/2015 | Baron | B05B 15/06 |
| 9,574,307 | B2 * | 2/2017 | Corbett | B29C 49/0047 |
| 2004/0206776 | A1 * | 10/2004 | Awbrey | B65D 23/003 222/105 |
| 2005/0247732 | A1 * | 11/2005 | Duke | B65D 75/5883 222/183 |
| 2006/0144855 | A1 * | 7/2006 | Von Schuckmann | 222/95 |
| 2006/0289567 | A1 * | 12/2006 | Shoham | A61B 90/80 222/175 |
| 2010/0140280 | A1 * | 6/2010 | Burke et al. | 220/672 |
| 2012/0168461 | A1 | 7/2012 | Topits et al. | |
| 2012/0248117 | A1 * | 10/2012 | Corbett et al. | 220/495.06 |

* cited by examiner

FOOD POUCH CONTAINER

RELATED APPLICATIONS

The present application claims priority to the U.S. Provisional Application Ser. No. 61/929,206, filed on Jan. 20, 2014, by Timothy Fellin et al., and entitled "FOOD POUCH CONTAINER," the entire disclosure of which is incorporated by reference herein, including the drawings.

FIELD OF THE INVENTION

The present invention is in the field of food containers, and in particular in the field of containers for food pouches.

BACKGROUND OF THE DISCLOSURE

Recently, there has been an increased growth in the use and marketing of food pouches, also referred to as stand-up pouches, especially for use with baby food. The food pouches are easy to use for the parents and the children can suck the food out of the pouch. The use of the food pouch eliminates the need for a glass baby food jar, and the need to spoon feed the food to the infant or toddler, thereby reducing the mess that is often accompanied when one is feeding a child.

However, the food pouches themselves can create mess. Invariably, the flow of food through the opening of the pouch is not controlled. Therefore, when the child squeezes the food pouch, the food squirts from the top opening and can soil the child's clothing or chair. Thus, there is a need in the art to retain the convenience of the food pouch but reduce or prevent the accompanying mess that the use of the pouch produces.

SUMMARY OF THE INVENTION

Disclosed herein are food pouch containers comprising a back portion having an interior cavity; a front portion; a top hole; and a surface dividing the back portion into an upper cavity, inside the back portion, and a lower cavity. In some embodiments, the lower cavity is inside the back portion, while in other embodiments, the lower cavity is an exterior cavity. Also disclosed are food pouch containers comprising a back portion having an interior cavity; a front portion; a top hole; means for contouring the food pouch from a bottom thereof; and means for contouring the food pouch from at least a side thereof.

DETAILED DESCRIPTION OF THE EMBODIMENTS

Disclosed herein are containers for holding a food pouch. The interior of the containers disclosed herein comprise elements on the sides and the bottom that are designed to contort the shape of the food pouch in such a way as to allow the food to easily be accessible to the user, e.g., a child, regardless of the amount of food left in the pouch. Some embodiments of the presently disclosed containers prevent the area around the neck of the pouch to collapse and create a vacuum.

The various embodiments of the presently disclosed containers are now described in view of the drawings.

Figure 1:
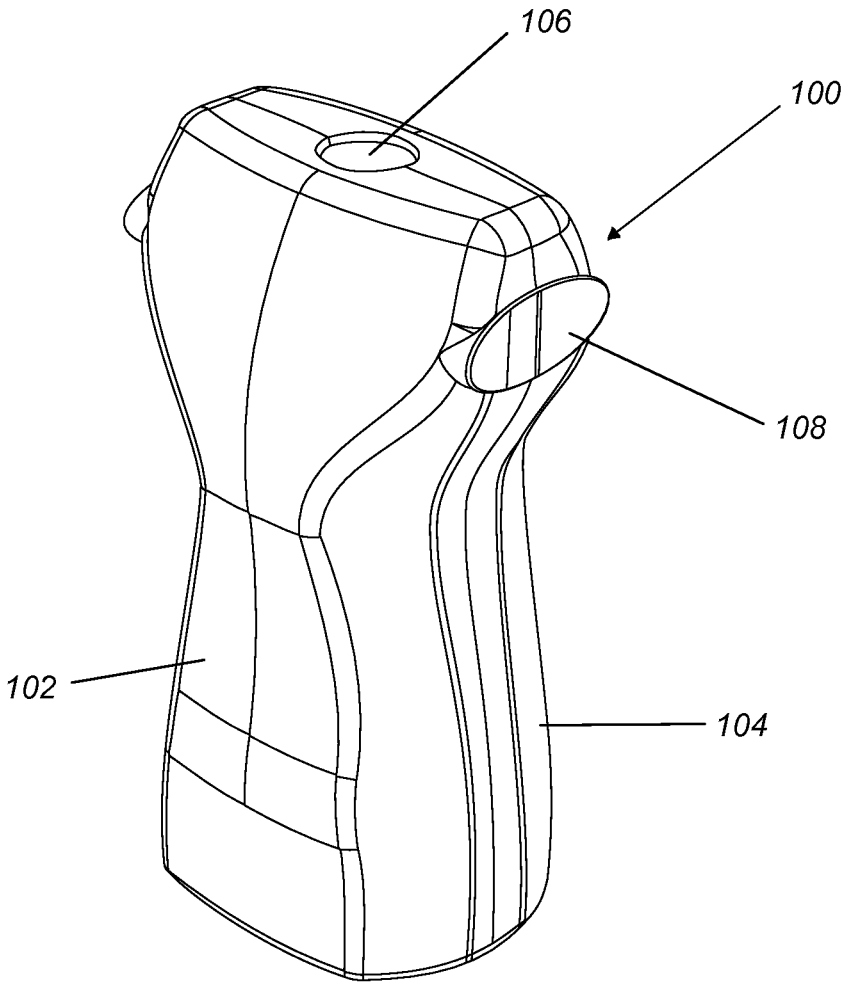
FIG. 1 illustrates an embodiment of the food pouch container disclosed herein in its closed configuration.

FIG. 1 shows an embodiment of the presently disclosed container 100 in its closed formation. The container 100 comprises a body, having a front portion 102 and a back portion 104. The container 100 also comprises a top opening 106, from which the nozzle or mouthpiece of a food pouch protrudes once the food pouch is placed inside the container 100. In some embodiments, tabs 108 are placed on either side of the container 100, which are configured to ease the opening of the container 100 so that a new pouch can be placed therein or a used pouch be removed therefrom.

The body is constructed of a rigid, childsafe material, such as plastic, wood, shatterproof glass, metal, or other rigid material, which holds the food pouch or food bag and preferably prevents a consumer from expelling the contents of the food pouch or food bag by squeezing.

Figure 2:
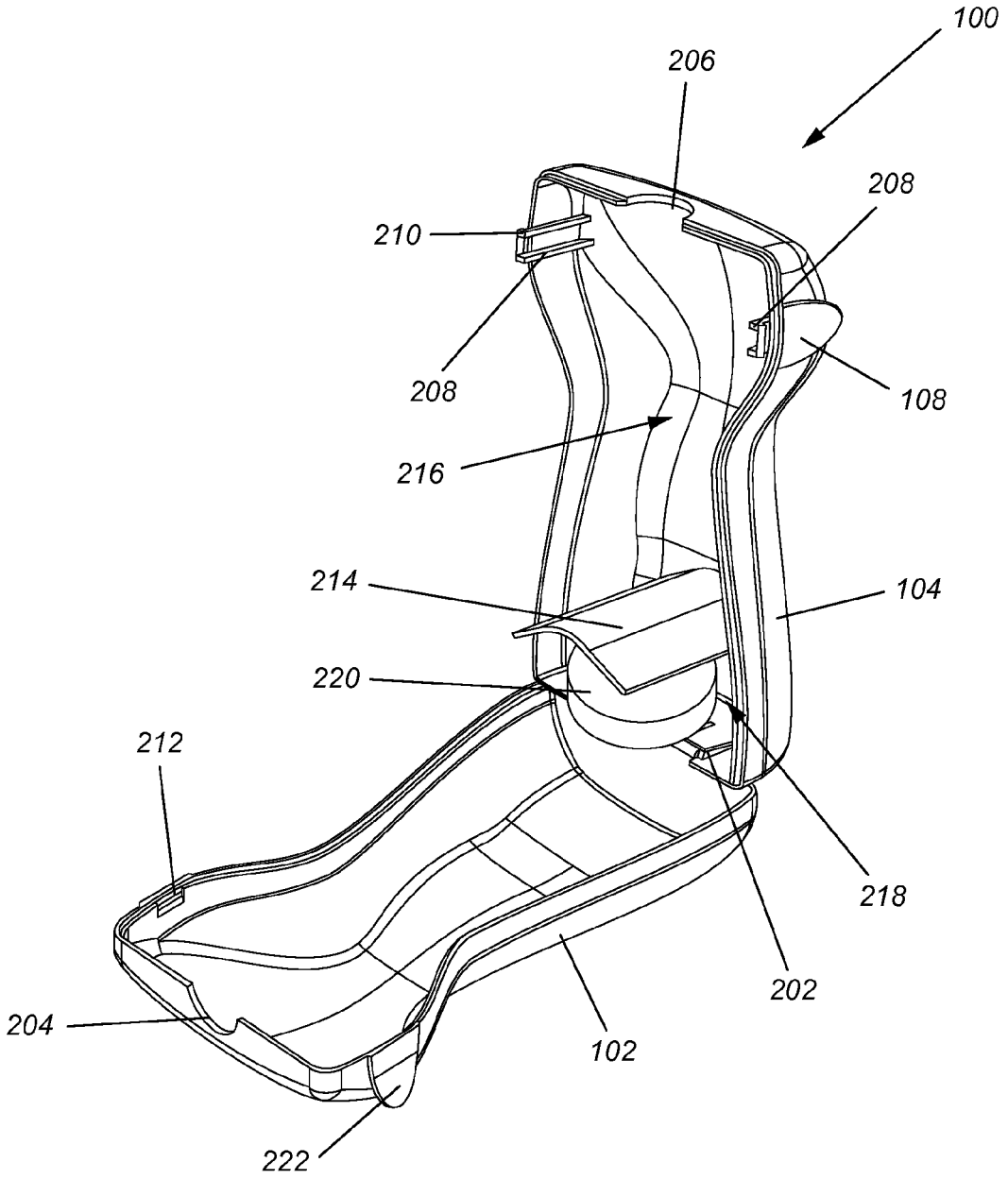
FIG. 2 illustrates an embodiment of the food pouch container disclosed herein in its open configuration.

FIG. 2 shows an embodiment of the presently disclosed container 100 in its open formation. In some embodiments, for example that shown in FIG. 2, the front portion 102 and the back portion 104 are attached together at the bottom of the container 100, i.e., the side opposite of the top opening 106, by a hinge 202, which is described more fully below. In other embodiments, when the container 100 is opened, the front portion 102 and the back portion 104 become separated.

In some embodiments, for example that shown in FIG. 2, the top opening 106 comprises of two semicircle sections. One semicircle portion 204 is cut into the front portion 102, whereas another semicircle 206 is cut into the back portion 104. In some embodiments, the semicircles 204 and 206 are of the same size, i.e., they each define an arc of 180°. In other embodiments, and primarily depending on the thickness of the top edges of the front portion 102 and the back portion 104, the semicircles 204 and 206 may be of a different size. For example, one of the semicircles 204,206 defines an arc>180°, while the other of the semicircles 204,206 defines an arc<180°.

In some embodiments (not shown), the top opening 106 is in the shape of a square, a rectangle, a rhombus, a parallelogram, a triangle, a trapezoid, or another geometric shape. In these embodiments, the front portion 102 and the back portion 104 comprise the two halves of the top opening 106, which when the container 100 is closed, the two halves form the square or the rectangle. Thus, in these embodiments, the front portion 102 and the back portion 104 do not comprise semicircles, but comprise the halves of the top opening 106.

In some embodiments, once the container 100 is closed, the front portion 102 and the back portion 104 are held together by at least one latch. The latch may be placed anywhere along the perimeter of the container 100. In some embodiments, the latch is along the internal perimeter of the container 100, whereas in other embodiments, the latch is along the external perimeter of the container 100. In some embodiments, the latch is towards the top of the container 100. In these embodiments, the bottom of the container 100 comprises a hinge or other mechanism, such as a tab and slot, or a friction lock mechanism. In other embodiments, the latch is towards the bottom of the container 100. In these embodiments, the top of the container 100 comprises a hinge or other mechanism, such as a tab and slot, or a friction lock mechanism. In some embodiments, the latch is on one of the sides of the container 100.

In some embodiments, for example that shown in FIG. 2, the back portion 104 comprises two latches 208, located at either side of the top of the back portion 104. In some embodiments, each latch 208 comprises a lip 210 (also referred to as a raised member), which points outward. The front portion 102 comprises corresponding indents 212. When the container 100 is closed, the lip 210 of the latch 208 catches inside the indent 212 and causes the front portion 102 and the back portion 104 to remain connected. In other embodiments, the latch 208 engages a corresponding portion in the front portion 102 to create a friction lock. In the embodiment shown in FIG. 2, the lip 210 and the indent 212 are shown as lines. In other embodiments, the lip 210 and the indent 212 may have another geometrical shape, for example a circle, a semicircle, or a hemisphere.

In certain embodiments, tabs 108 are placed on the outside of the back portion 104, in a place corresponding to the latches 208. When the tabs 108 are pressed, the latches 208, and consequently the lips 210, are pushed to the interior cavity of the back portion 104. If the latches 208 are engaged with the indents 212, then pressing on the tabs 108 releases the lips 210 from the indents 212. The front portion 102 and the back portion 104 can then be easily separated. Tab 222 is provided on the front portion 102 to provide additional friction for when a user chooses to open the container 100. Thus, in these embodiments, to open the container 100, a user can hold the back portion 104 by the tabs 108 and the front portion 102 by the tabs 222. The user then exerts pressure on the tabs 108 to release the latches 208 from the indents 212. Then the user pulls the tabs 108 away from the tabs 222.

In the embodiments, where the latches 208 form a friction lock with the front portion 102, the tabs 108 solely provide a friction hold for the user, similar to the tabs 222.

While the latch mechanisms here have been described with the reference to their placement on either the front portion 102 or the back portion 104, the skilled artisan recognizes that the arrangement can easily be reversed. The reversed arrangement is specifically contemplated.

In some embodiments, a surface 214 divides the interior cavity of the back portion 104 into an upper cavity 216 and a lower cavity 218. In some embodiments, for example that shown in FIG. 2, the surface 214 is a cantilever, whereas in other embodiments, the surface 214 is a shelf. In certain embodiments, the surface 214 is arced, whereas in other embodiments, the surface 214 is flat. In some embodiments, the surface 214 is fixed in place. In other embodiments, the position of the surface 214 is changed upward or downward, as described more fully below. In some embodiments, the upper cavity 216 is configured to receive a food pouch (not shown). In certain embodiments, the lower cavity 218 is configured to optionally hold the cap 220 of the food pouch. This embodiment is illustrated in FIG. 2.

Throughout the present disclosure and the claims, the direction "up," "top," or "upper" refers towards the location where the mouthpiece of a food pouch fits into the container. The direction "down," "lower," or "bottom" refers towards the location where the bottom of the food pouch fits into the container. Thus, for example, the top hole 106 is at the top and the surface 214 is at the bottom with respect to the top hole. In other words, the surface 214 is "lower" than the top hole 106.

Throughout the present disclosure, the "front" and "back" refer to the location of the surface 214. Thus, whichever portion that comprises the surface 214 is considered the "back" portion, regardless of how the container is held by the user.

Figure 3A:
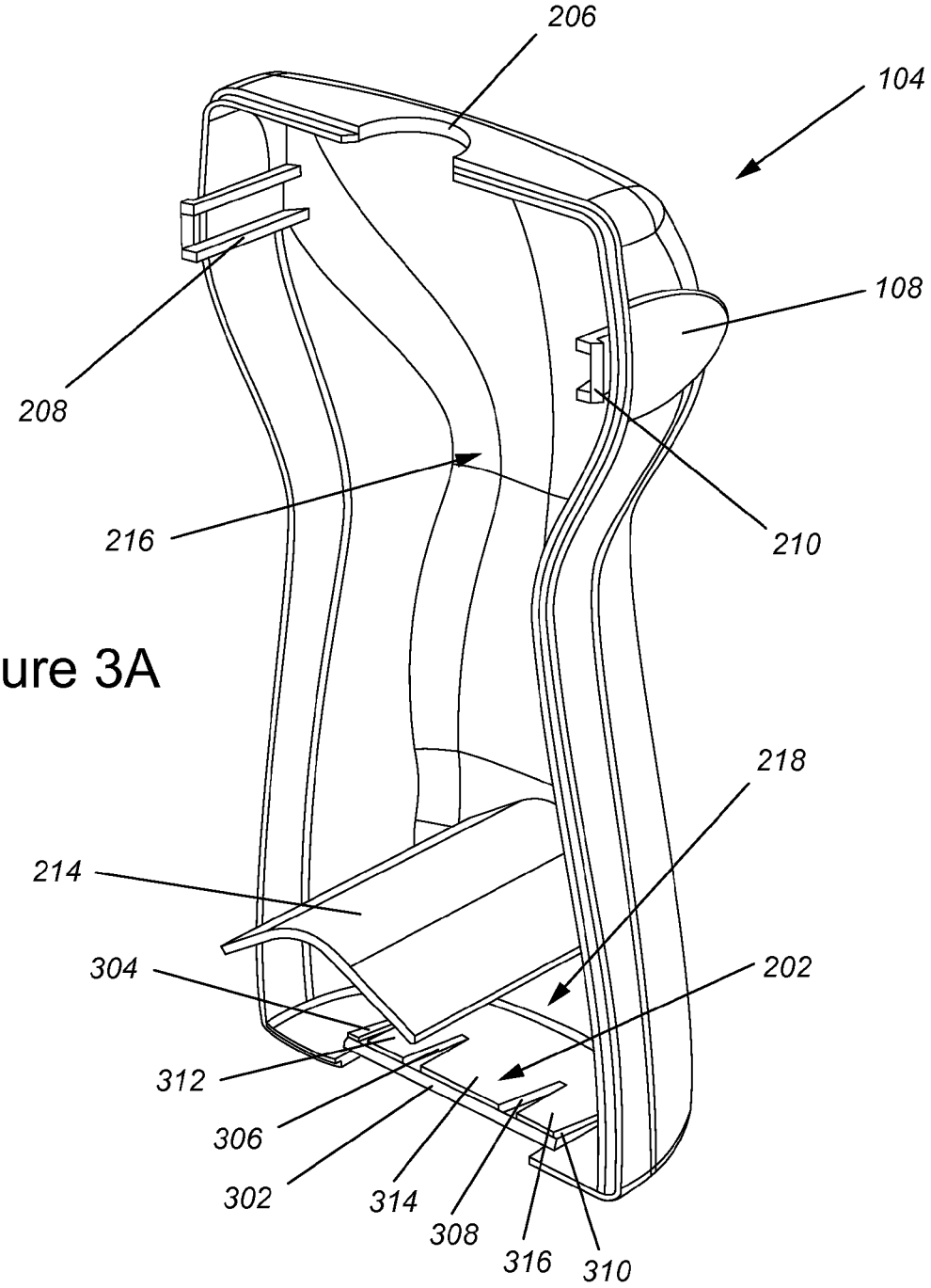
FIG. 3A illustrates the view of the interior of an embodiment of the back portion of the food pouch container disclosed herein in its open configuration.
Figure 3B:
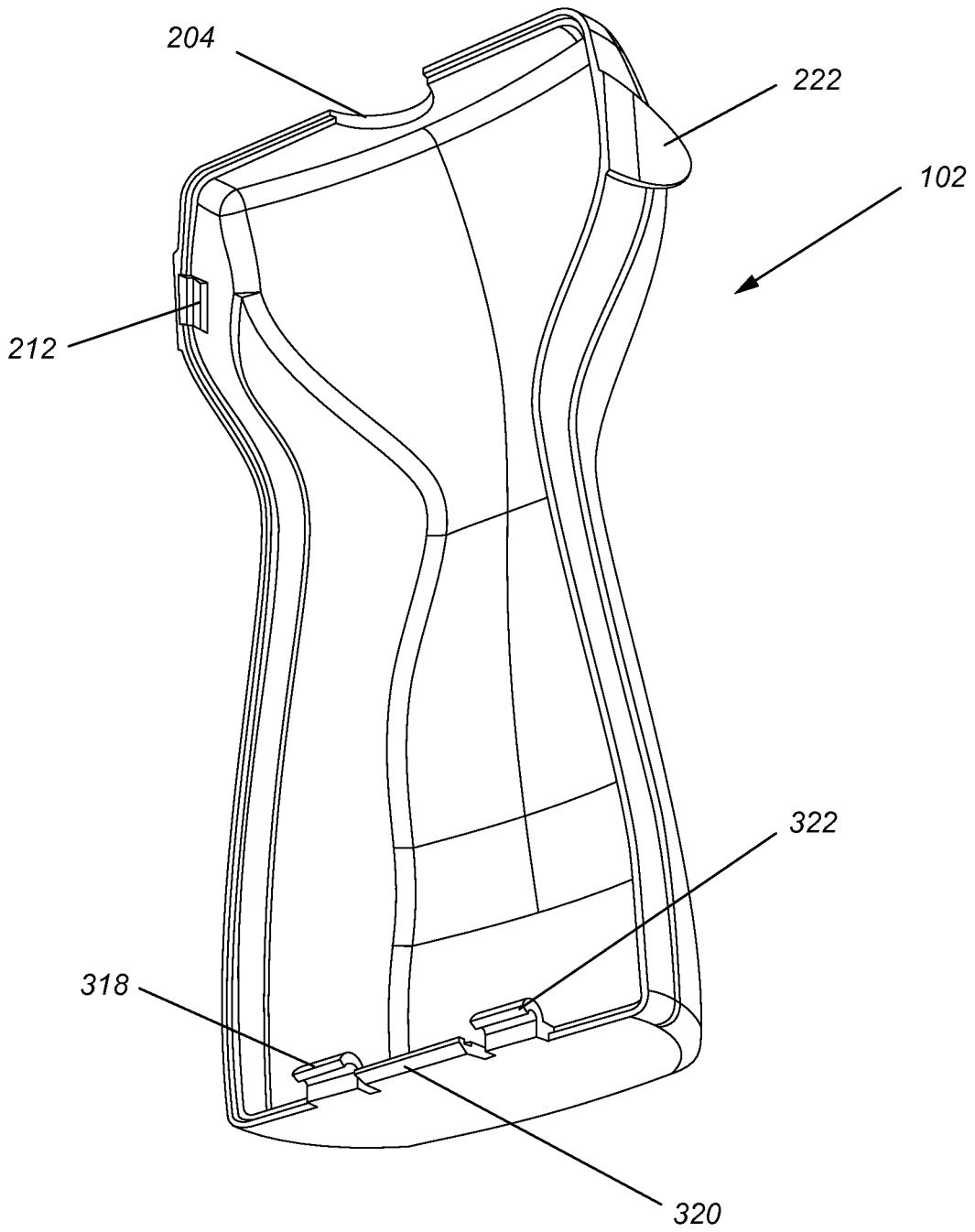
FIG. 3B illustrates the view of the interior of an embodiment of the front portion of the food pouch container disclosed herein in its open configuration.

FIG. 3A provides a clearer view of the back portion 104, without the presence of the front portion 102 or the cap 220. The back portion of the hinge 202 is also illustrated. FIG. 3B provides a clearer view of the front portion 102 back, without the presence of the portion 104.

In the illustrated embodiment, the back of the hinge 202 on the back portion 104 (FIG. 3A) comprises a bar 302. Ridges 304,306,308,310 divide the hinge 202 portion into three areas 312, 314, and 316. The front edge of each of the areas 312,314,316 is open. The front of the hinge 202 on the front portion 102 (FIG. 3B) comprises three curved members. The outer members 318 and 322 are arced downward whereas the central member 320 is arced upward. When the front portion 102 and the back portion 104 are joined together, the outer members 318 and 322 catch the bar 302 in front of areas 316 and 312, respectively, such that the bar 302 is placed under the curved members 318 and 322. Simultaneously, the central member 320 catches the bar 302 in front of area 314 such that the bar 302 is placed above the curved member 320. Thus, a hinge is formed.

Figure 3C:
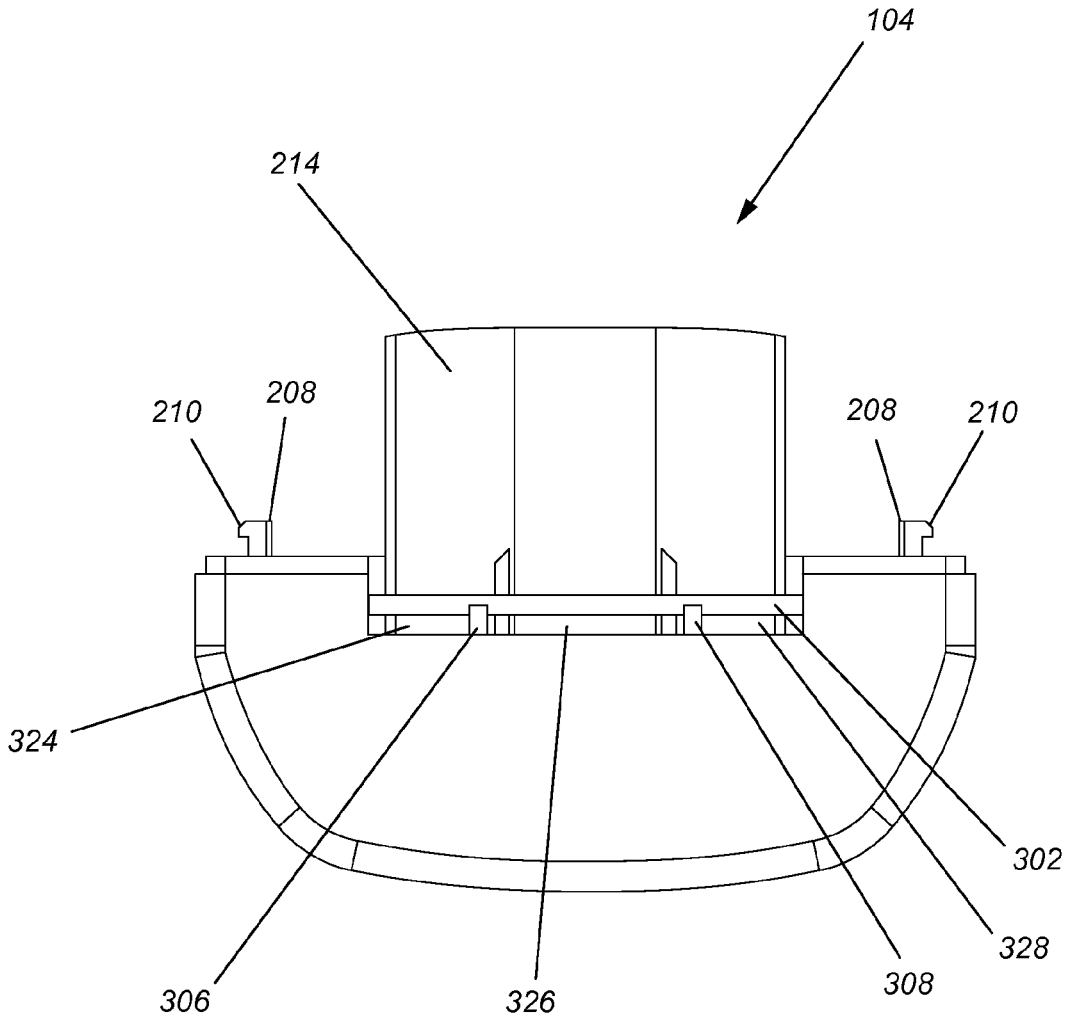
FIG. 3C illustrates the bottom view of an embodiment of the back portion of the food pouch container disclosed herein in its open configuration.

FIG. 3C is a bottom view of the back portion 104 showing the position of the bar 302, the ridges 306,308 and the openings 324, 326, and 328 in front of the areas 312, 314, and 316, respectively.

Other methods of forming a hinge are known in the art and are contemplated herein. For example, in some embodiments, the front portion 102 comprises a plurality of semi-circular members that catch the bar 302, thus forming a hinge. In other embodiments, more or fewer curved members are placed on the front portion 102. In other embodiments, the curved members 318,320,322 are placed on the back portion 104, whereas the bar 302 is placed on the front portion 102. Any other configuration that allows for a hinge to be formed is contemplated.

In some embodiments, the front view of the container 100 comprises a generally rectangular shape. In other embodiments, the front view shape of the container 100 is square. In other embodiments, the front view shape of the container 100 comprises another geometrical shape, for example a circle, a triangle, and the like.

Figure 4:
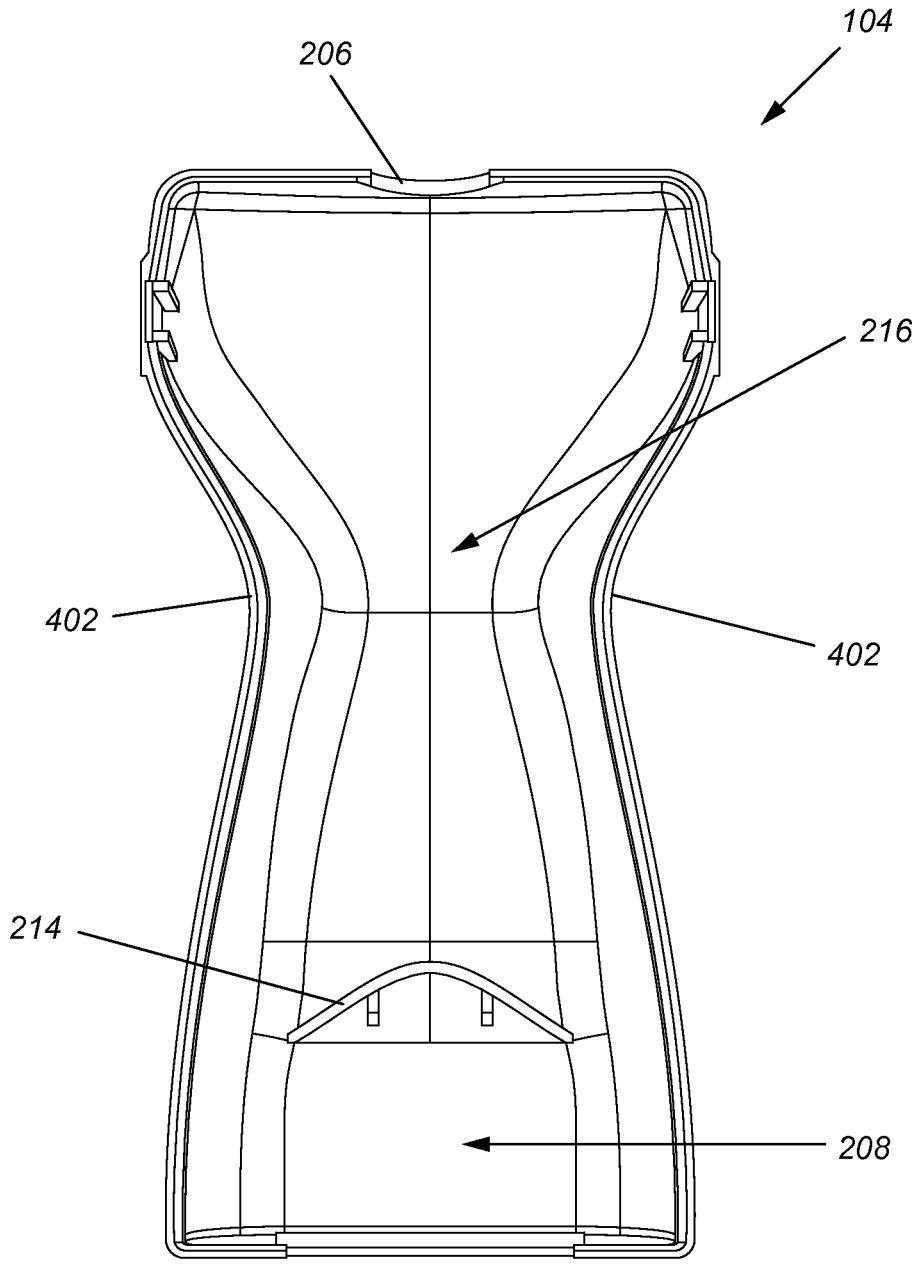
FIG. 4 illustrates the view of the interior of an embodiment of the back portion of the food pouch container disclosed herein in its open configuration.

FIG. 4 shows the front view of the back portion 104. The illustrated embodiment comprises a generally rectangular shape, with the addition of side pinches 402 at either side of the back portion 104. As can be seen from the illustrated embodiments of FIGS. 1-3, corresponding side pinches appear on the front portion 102 as well. The upper cavity 216, then is defined at the top by the top of the container 100, and the top opening 206; at the bottom by the surface 214; and at the sides by the sides of the container 100 having the side pinches 402. A food pouch is placed in the upper cavity 216 such that the bottom of the food pouch rests on the surface 214, and attains the generally curved shape of the surface 214. The nozzle of the food pouch protrudes from the top opening 206. The sides of the food pouch are also curved due to the curvature caused by the side pinches 402.

In some embodiments, the user can choose to store the cap of the food pouch in the lower cavity 208 while the child is consuming the food in the food pouch, thereby reducing the chances of the cap getting lost or dirty.

The inventors have discovered that when a food pouch is partially used, vacuum is generated at the top of the food pouch and the body of the pouch collapses. While there is still plenty of food within the pouch, a child cannot access it easily because of the collapsed body of the pouch near the nozzle. The child will then need to suck forcefully, which results in the tiring of, and aches in, the jaw. However, in some embodiments, when the food pouch is placed in the container 100 as described herein, where the food pouch attains the curvatures discussed above, there is created a "pinch" by the side pinches 402 and a "push" by the surface 214. Consequently, in these embodiments, the body of the pouch does not collapse and the child can easily access the entirety of the food in the pouch, without having to suck forcefully.

Figure 5A:
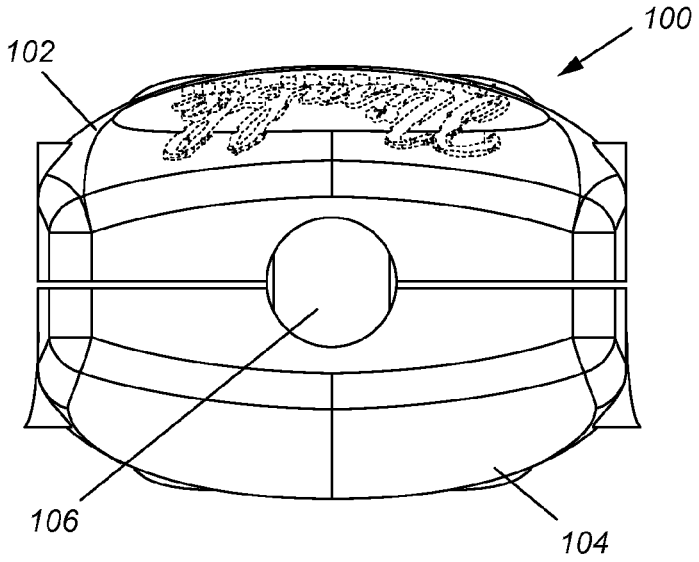
FIG. 5A illustrates the top view of an embodiment of the food pouch container disclosed herein in its closed configuration.
Figure 5B:
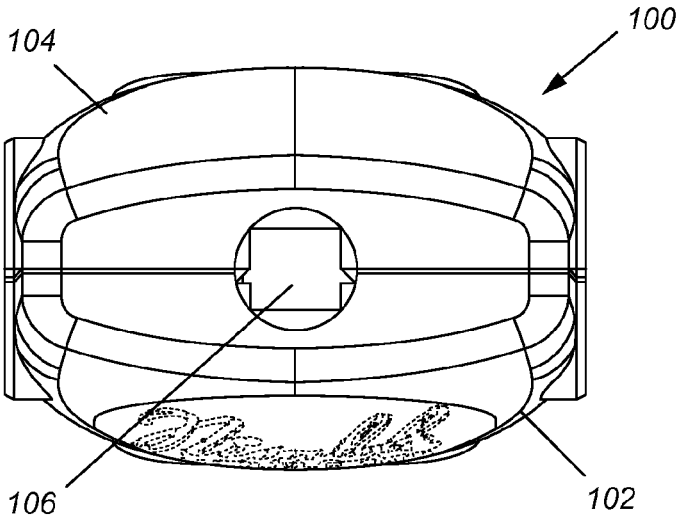
FIG. 5B illustrates the top view of another embodiment of the food pouch container disclosed herein in its closed configuration.

FIG. 5 illustrates two embodiments of the top opening 106 of the container 100. In FIG. 5A, the top opening 106 is circular and is configured to accommodate a food pouch having any shape nozzle. However, the standard nozzle for the pouches currently on the market has a square cross section. The embodiment of FIG. 5B is a square top opening 106. The advantage of this embodiment is that when the food pouch is placed in the container 100, the cap of food pouch can be twisted open or closed without the need to hold the nozzle. In these embodiments, when the cap is twisted open or closed, the pouch itself does not twist. When the pouch twists, it can make it hard or impossible to suck contents out of nozzle.

Figure 6:
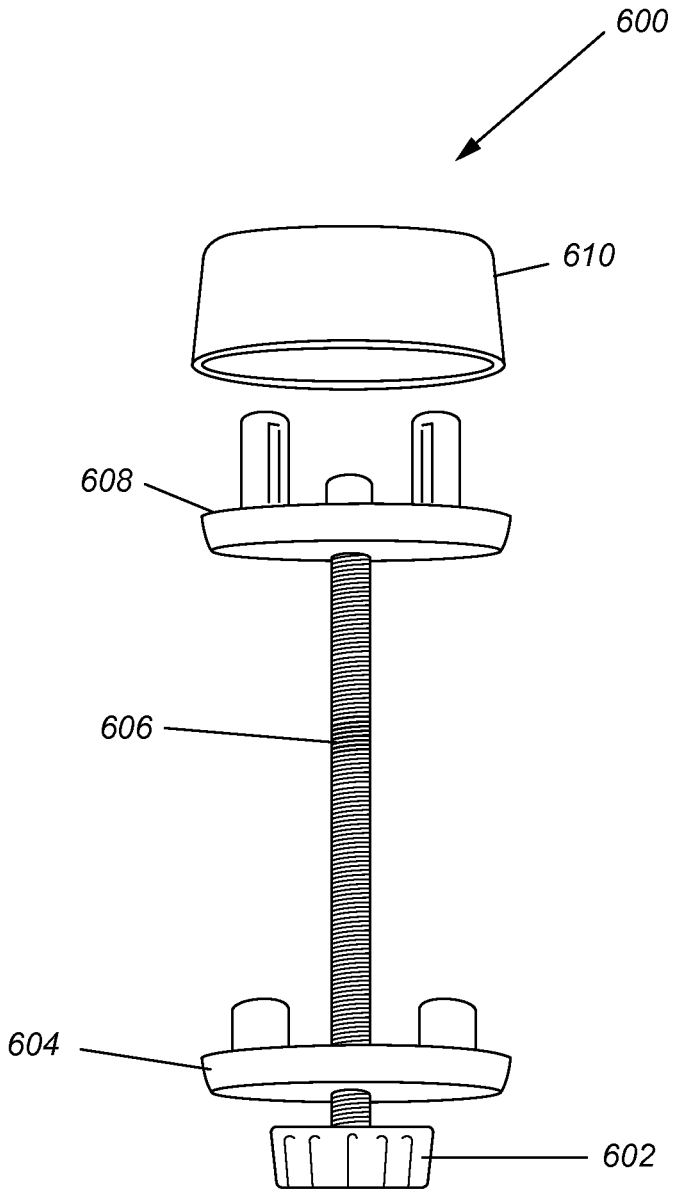
FIG. 6 illustrates an embodiment of a surface-adjusting mechanism disclosed herein.

In some embodiments, the surface 214 is not fixed to the back portion 104. In these embodiments, there exists a mechanism by way of which the surface 214 is moved up or down. In some embodiments, for example the one shown in FIG. 6, an adjusting mechanism 600 is incorporated into the container 100. The mechanism 600 comprises a knob 602, optionally a bottom plate 604, a threaded spindle 606, optionally a top shelf 608, and a cap 610. The mechanism 600 is incorporated such that the knob 602 is outside of the container 100, and located at the bottom thereof. The bottom plate 604, if present rests abutting the bottom of the container 100. The cap 610 serves the same function as the surface 214. In some embodiments, the shape of the top of the cap 610 is flat, whereas in other embodiments, the top of the cap 610 is curved, having the same design as the surface 214 shown in FIG. 2. The top shelf 608 is optionally present to provide additional stability to the cap 610. The user can rotate the knob 602, thereby moving the cap 610 up or down, providing more or less pressure on the food pouch, as the need may be.

In other embodiments, there is provided a boss at the bottom of the container 100, which boss is in contact with a cap. When the user pushes the boss in, towards the top of the container 100, the cap also moves upward providing additional pressure for the food pouch. Once the food pouch is used and prior to the insertion of a new food pouch, the user moves the cap back down to its original location.

In other embodiments, there is provided a roller inside the container 100, the roller having a slot therein. The roller is connected with at least one knob, which is placed along a track, at the side of the container 100 on the outside. When the knob is turned, the roller turns as well. The user inserts the bottom of the food pouch in the roller's slot. As the knob is turned, the roller turns, thereby rolling the food pouch from the bottom, and squeezing the food out of the food pouch. This action is similar to rolling a toothpaste tube from the bottom.

Figure 7:
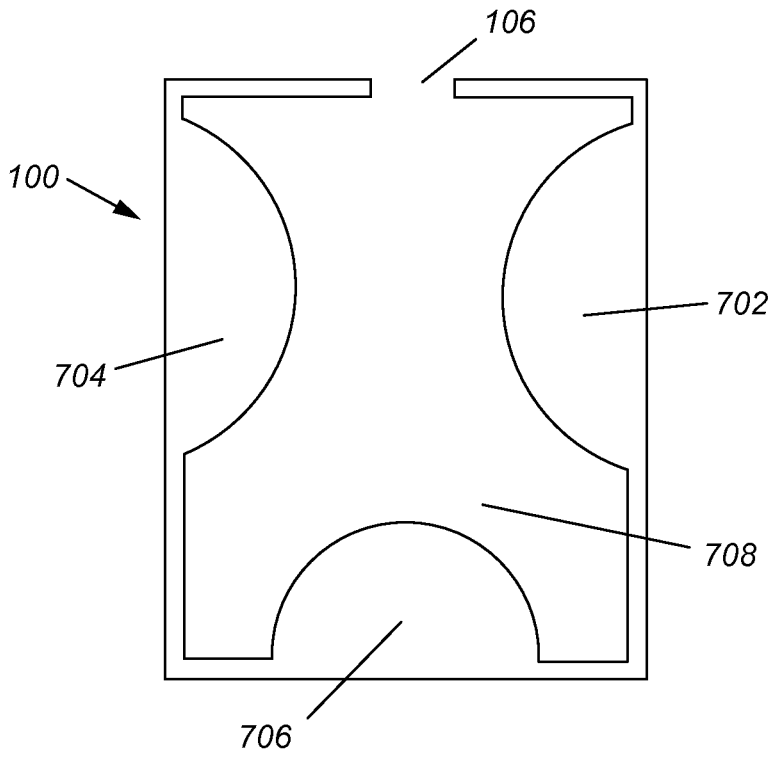
FIG. 7 illustrates the cross section of an embodiment of the food pouch container disclosed herein.

In yet another embodiment, shown in FIG. 7, there is provided a container 100 having phantom walls. When viewed from the outside, i.e., when the container 100 is closed, the container has a generally rectangular shape. However, on the inside, there are solid curved side walls creating spaces 702,704 and a solid curved bottom creating space 706. The walls creating spaces 702,704 operate similarly as the side pinches 402, described above, while the bottom creating space 706 operates similarly as the surface 214, described above.

In some embodiments, the space 702,704 and/or bottom 706 are each independently hollow (see, for example, FIG. 11C, below), while in other embodiments, the spaces are each independently filled.

Figure 8:
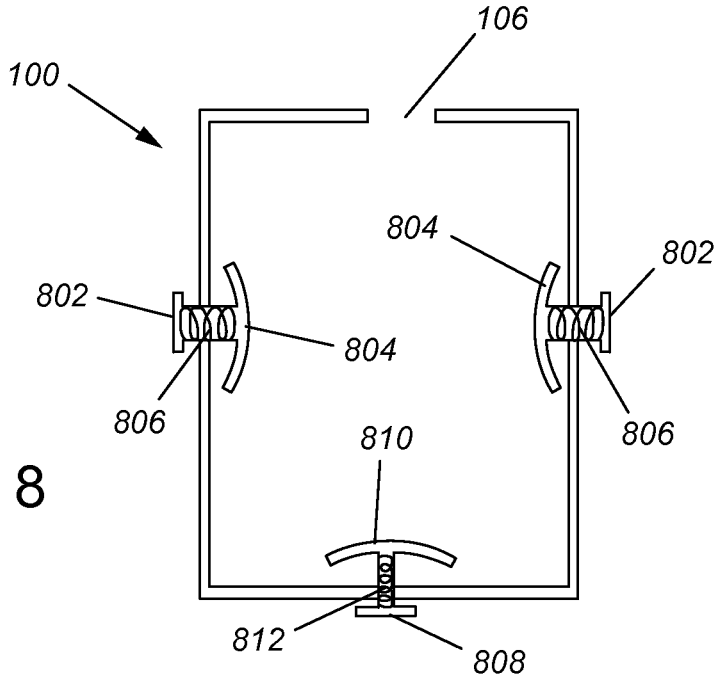
FIG. 8 illustrates the cross section of another embodiment of the food pouch container disclosed herein.

In still another embodiment, shown in FIG. 8, there is provided a container 100 having screwable pinches. One or more knobs 802 are placed at the side of the container 100. Each knob is connected to a pinch 804 via a threaded spindle 806. In some embodiments, the inward surface of the pinch 804 is flat, whereas in other embodiments, for example the one shown in FIG. 8, the inner surface of the pinch 804 is curved. When the knob 802 is turned, the pinch moves inward, providing side pressure to the food pouch. Similarly, there is provided a bottom knob 808, which is connected to a bottom pinch 810 via a threaded spindle 812. The turning of the knob 808 causes the bottom pinch 810 to move upward, providing bottom pressure to the food pouch. Prior to inserting a new food pouch, the user turns the pinches to their original, fully open position, giving the maximum cavity space. Some embodiments comprise only side pinches 804, while other embodiments, comprise only the bottom pinch 810. Still other embodiments comprise one side pinch 804, while other embodiments comprise more than two side pinches 804 and/or two or more bottom pinches 810.

Figure 9A:
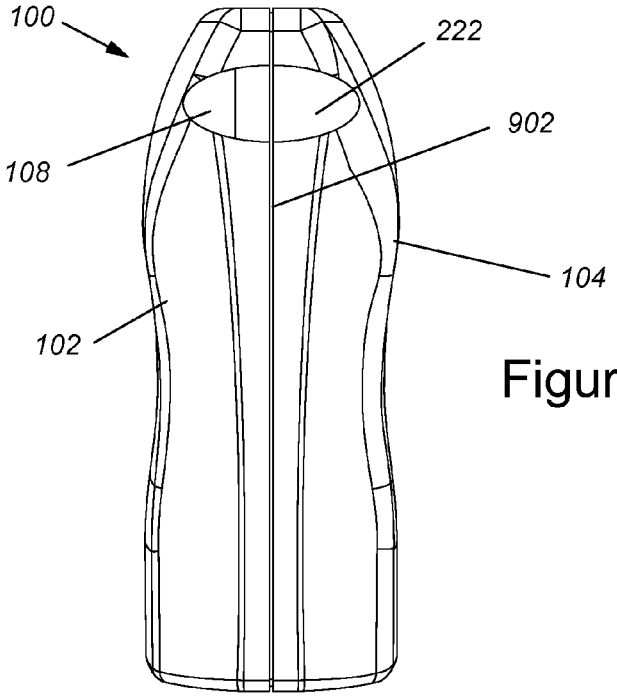
FIG. 9A illustrates the side view of an embodiment of the food pouch container disclosed herein in its closed configuration.
Figure 9B:
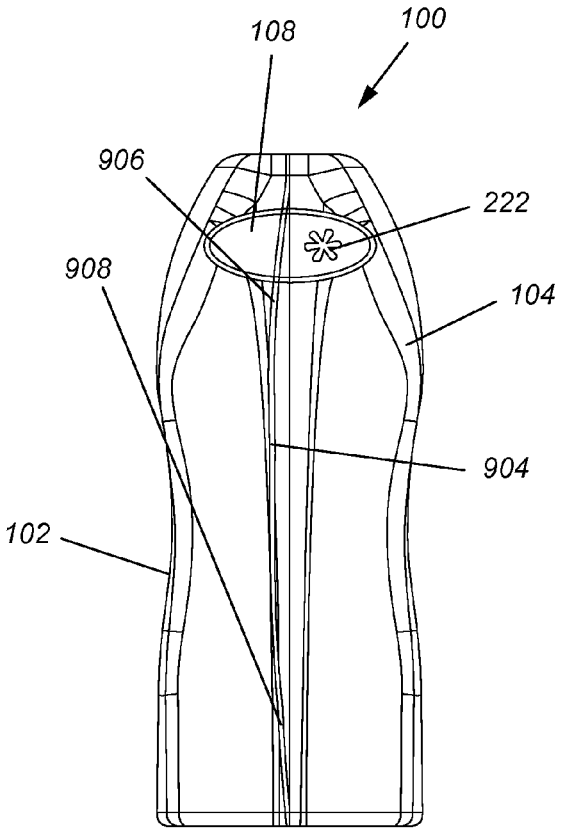
FIG. 9B illustrates the side view of another embodiment of the food pouch container disclosed herein in its closed configuration.

In some embodiments, the front portion 102 and the back portion 104 have the same proportions. In these embodiments, for example as shown in FIG. 9A, the centerline 902 is even. However, in some embodiments, the back portion 104 is slightly larger than the front portion 102, to provide a deeper cavity for the food pouch at the time of insertion, which makes the placement of the food pouch easier. An example of this embodiment is shown in FIG. 9B, where the centerline 904 is offset, as emphasized by the arrows 906 and 908. The offset centerline also provides for an easier means to close the container 100 when a food pouch is installed.

Figure 10A:
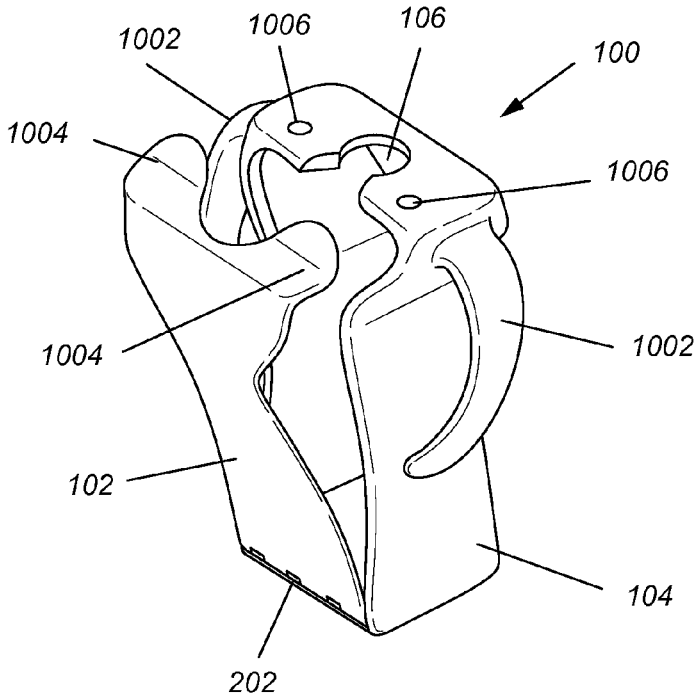
FIG. 10A illustrates the perspective view of an embodiment of the food pouch container disclosed herein, having handles, in its open configuration.
Figure 10B:
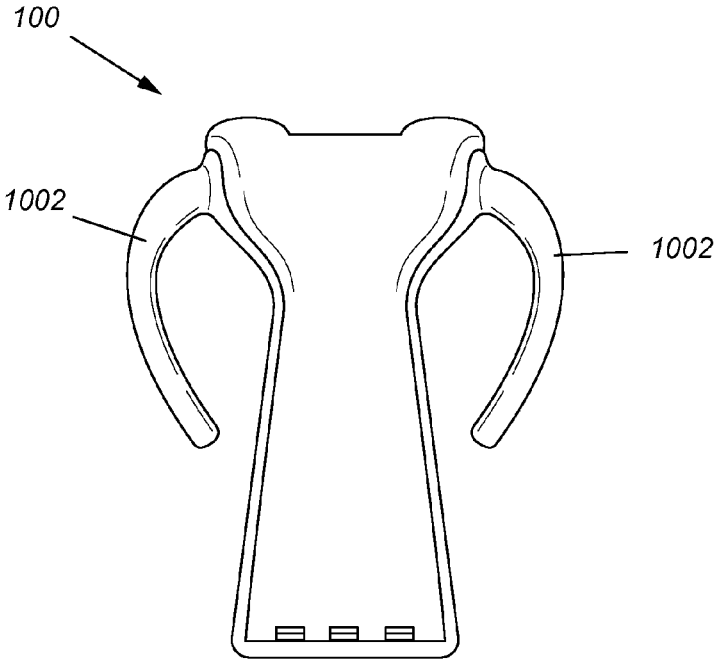
FIG. 10B illustrates the front view of an embodiment of the food pouch container disclosed herein, having handles, in its closed configuration.

In some embodiments, the container 100 disclosed herein comprises handles. An example of this embodiment is shown in FIG. 10. FIG. 10A shows a perspective view of the container 100, showing the front portion 102 partially separated from the back portion 104, while FIG. 10B shows a front view of this embodiment of the container 100. Handles 1002 allow the child to hold the container 100 while consuming the contents of the food pouch, without dropping the container.

FIG. 10A also illustrates another embodiment of a latch, which can be used with any of the embodiments of the container 100 disclosed herein. This embodiment comprises one or more latch mechanisms, each of which is an extension 1004 pointing towards the opposite portion of the container 100. For instance, if the extension 1004 is located on the front portion 102 of the container 100, as shown in FIG. 10A, then the extension 1004 points towards the back portion 104, and vice versa. The extension 1004 comprises at least one raised member (also referred to as a lip) (not shown). The portion opposite to the one having the extension 1004, for example the back portion 104 if the extension is on the front portion 102, comprises one or more indents 1006. When the front portion 102 and the back portion 104 are brought together in the closed configuration, the raised member of the extension 1004 forms a friction lock with the indent 1006. In some embodiments, for example the one shown in FIG. 10A, the raised member and the indent 1006 are circular. In other embodiments, they comprise a different cross section, for example a line, a rectangle, a square, a triangle, or another regular or irregular geometric shape. In some embodiments, the indent is on the extension 1004 and the raised member is on the opposite portion.

The embodiment shown in FIG. 10A does not have a surface 214. Instead only the side pinches 402 alone provide the necessary contour change to the food pouch. Thus, in some embodiments, the container 100 has a surface 214 without the side pinches 402, while in other embodiments, the container 100 has the side pinches 402 without a surface 214, and in still other embodiments, the container 100 has both the side pinches 402 and a surface 214.

While the embodiment of FIG. 10A shows a container 100 that has the handles 1002, the latch mechanism having extensions 1004 and indents 1006, and no surface 214, the skilled artisan recognizes that any of these features can be incorporated to any of the various embodiments of the container 100 disclosed herein. Thus, for example, the container 100 of FIG. 1, 5, 7, 8, 9, 11, or 12 can be made to have handles 1002, the latch mechanism having extensions 1004 and indents 1006, or no surface 214. And likewise, the embodiment of FIG. 10 can be made with no handles 1002, a latch mechanism other than one having extensions 1004 and indents 1006, or a surface 214.

FIGS. 11A-D show another embodiment of the container 100 disclosed herein. In some embodiments, for example the one shown in FIG. 11A, the front portion 102 is a cover, without having depth, and the back portion 104 comprises the entire depth of the container 100. In these embodiments, the food pouch is placed within the cavity of the back portion 104 and the front portion 102 closes shut to hold the food pouch within the container 100.

Figure 11A:
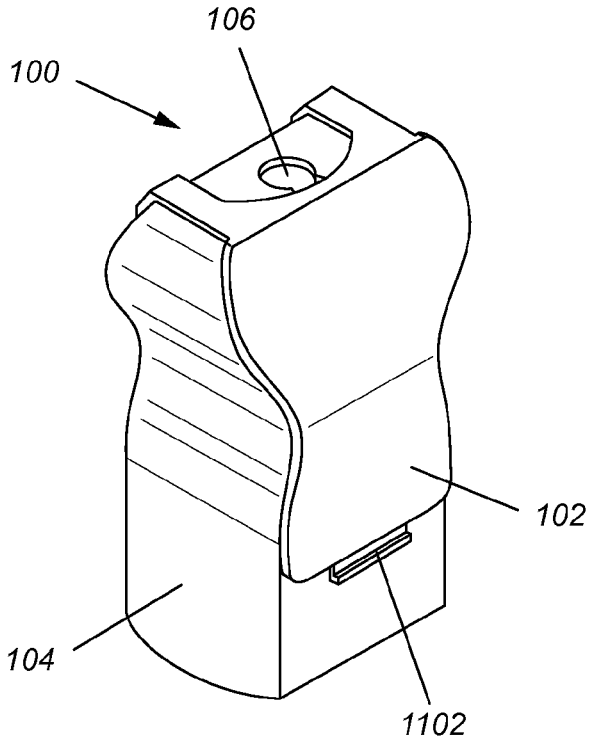
FIGS. 11A-11C illustrate an embodiment of the food pouch container disclosed herein in its closed configuration.
Figure 11B:
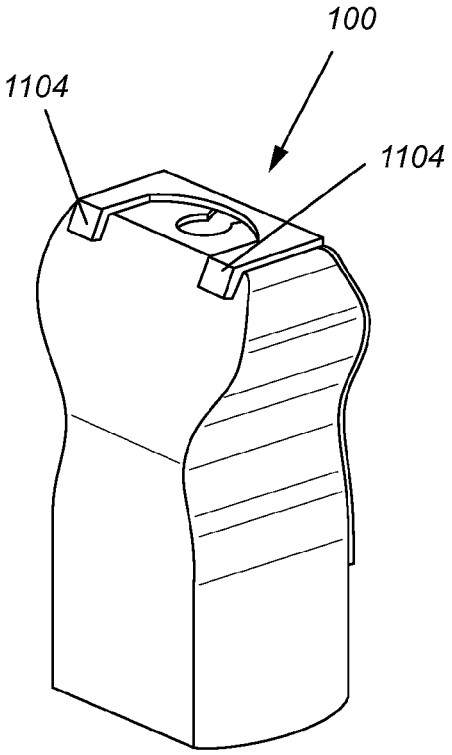

The embodiment of FIG. 11B shows latches 1104 that are external to the body of the container 100. In these embodiments, the downward distal end of the latch 1104 snaps on the reverse side of the back portion 104, resulting in securing the front portion 102 to the back portion 104. While this embodiment of a latch mechanism is disclosed in connection with the embodiment of FIG. 11, it is understood that this latch mechanism can be used with any of the presently disclosed containers 100.

Figure 11C:
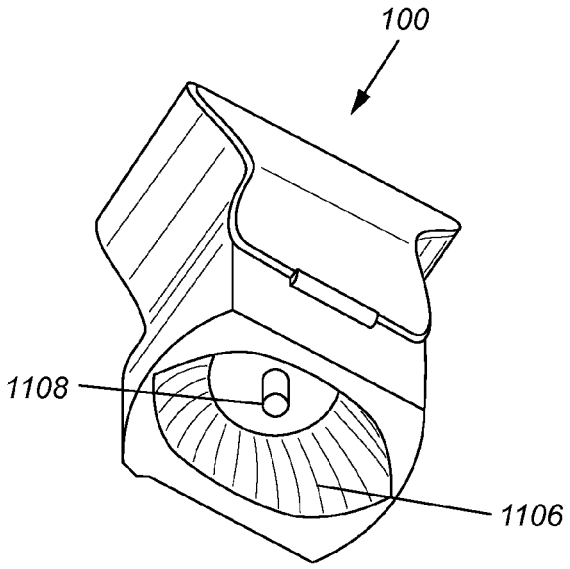

The embodiment of FIG. 11C is directed to a container 100 having a cap space 1106 at the bottom of the container 100. The cap space 1106 is a hollowed space into which the cap of the food pouch can be stored while the food pouch is opened for use. In some embodiments, for example that shown in FIG. 11C, a nubbin 1108 is present at the center of the cap space 1106, onto which the cap is threaded or snapped for a more secure hold.

Figure 11D:
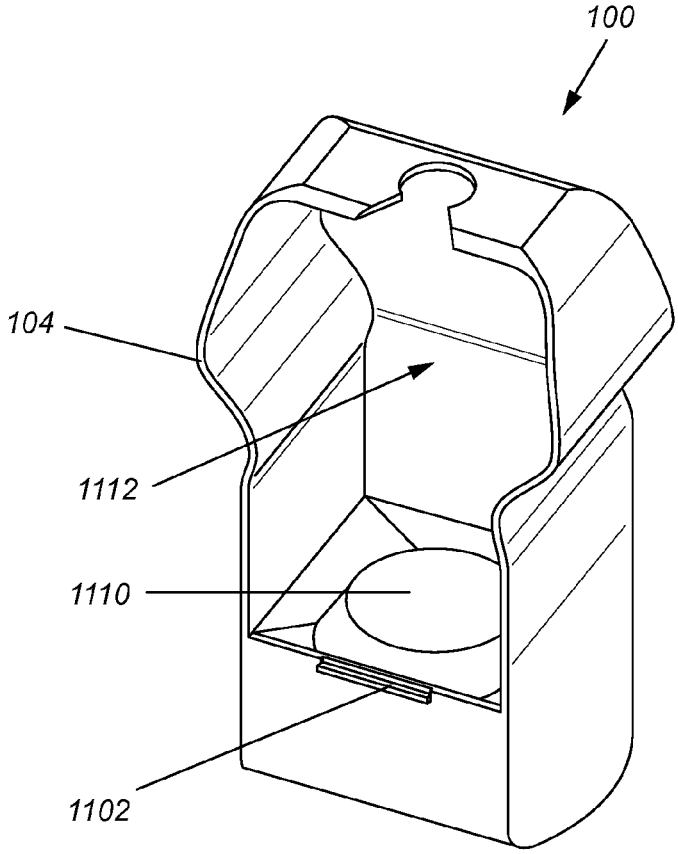
FIG. 11D illustrates the interior of the same embodiment of the food pouch container.

As shown in FIG. 11D, the cap space 1106 also causes a curved or raised surface 1110 to exist within the interior cavity of the container 100, for example similar to the curved top surface of the space 706, shown in FIG. 7. In this embodiment, the interior of the back portion comprises only one interior cavity, the upper cavity 1112, similar to the upper cavity 216, above. The lower cavity is an exterior cavity and is the cap space 1106. Thus, in some embodiments, the surface divides the back portion into an upper cavity and a lower cavity, where the lower cavity is on the exterior.

In some embodiments, for example the one shown in FIG. 11A, the hinge 1102 around which the front portion 102 separates from the back portion 104 is located at a point away from an edge of the container 100. For example, in FIG. 11A, the hinge 1102 is located approximately ⅕ of the way up from the bottom of the container 100. In certain embodiments, the hinge 1102 is located around the mid-section of the container 100.

In certain embodiments, the hinge 202,1102 is on the side of the container 100. In these embodiments, the front portion 102 opens from the opposite side of the hinge 202,1102. In other embodiments, the hinge 202,1102 is on the back side. In some of these embodiments, when the front portion 102 separates from the back portion 104, the bottom of the container 100 will also rotate away.

Figure 12A:
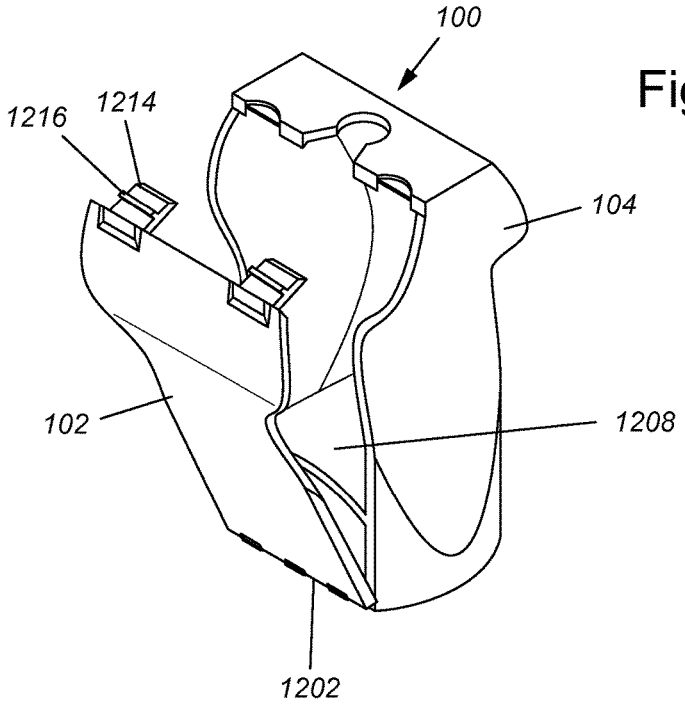
FIG. 12A illustrates an embodiment of the food pouch container disclosed herein in its open configuration.
Figure 12B:
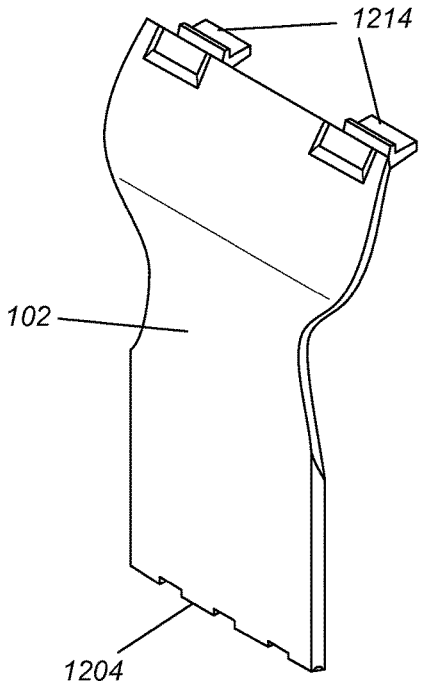
FIG. 12B illustrates the front portion and FIG. 12C illustrates the back portion thereof.
Figure 12C:
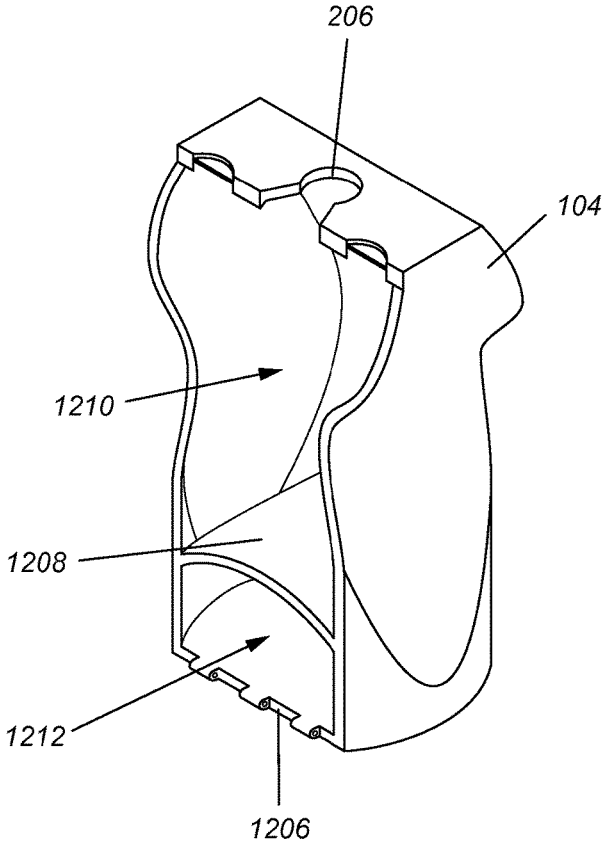

FIGS. 12A-12C illustrate another embodiment of the container 100. In this embodiment, the front portion 102, shown in FIG. 12B, has no depth. The entire depth of the container 100 is comprised in the back portion 104, shown in FIG. 12C. The hinge 1202 comprises two components: the front component 1204 located at the bottom of the front portion 102, and the back component 1206 located at the bottom front of the back portion 104. Thus, unlike the hinge 202 of the embodiment of FIG. 2, which is located in the middle area of the bottom of the container 100, when the container 100 is in its closed configuration, the hinge 1202 is located in the front of the bottom of the container 100, when the container 100 is in its closed configuration. A similar configuration can be applied to any of the containers 100 disclosed herein.

The surface 1208 curves downward and traverses the entire width of the back portion 104. The surface 1208 divides the interior cavity of the back portion 104 into the upper cavity 1210 and the lower cavity 1212. Thus, while the surface 1208 acts similarly to the cantilever surface 214 of the embodiment of FIG. 2, it is different in that the surface 1208 is connected to the sides of the back portion 104. In some embodiments, the lower cavity 1212 is filled and the interior cavity only comprises the upper cavity 1210. In other embodiments, the lower cavity 1212 is external. A similar configuration can be applied to any of the containers 100 disclosed herein.

In the embodiment shown in FIG. 12C, the top hole 206 is a semicircle defining an arc>180°. However, when the front portion 102 connects with the back portion 104 to close the container 100, the top hole 206 does not form a complete circle. Instead, the top hole 206 will comprise a straight edge formed by the front portion 102. This configuration makes it easier for a user to install the nozzle of the food pouch since the edge of the front portion 102 guides the nozzle into the semicircular part of the top hole 206. This configuration provides some of the advantages discussed above with respect to the embodiment shown in FIG. 5B. A similar configuration can be applied to any of the containers 100 disclosed herein.

The latch mechanism of the embodiment of FIG. 12 comprises at least one extension 1214, having at least one raised member (or lip) 1216. In the embodiment shown in FIG. 12, the extension 1214 is on the front portion 102, facing the back portion 104. Other configurations, as discussed above, for example, with the extension being on the side or on the back portion, are also contemplated. A corresponding indent (not shown) on the opposite portion, for example the back portion 104, creates a friction lock between the back portion 104 and the front portion 102.

In some embodiments, the body of the container 100 comprises an outer shell and an inner shell, with a lining space therebetween. In some embodiments, the lining space is filled with air. Air is a known insulator. In these embodiments, the contents of food pouch retain their temperature for a longer period of time than if a single shell container is used.

In other embodiments, the lining space is filled with a heatable and/or coolable fluid, for example a liquid or a gel. The user can heat the container, for example by placing the container in a microwave oven or warm water, thereby heating the fluid. In some embodiments, the fluid has a high specific heat, and therefore, loses its heat slowly. The heated fluid can then either heat the contents of the food pouch, or help in keeping the contents of a pre-heated food pouch warm.

Similarly, if the fluid is coolable, or also coolable, the user can place the food pouch in a refrigerator, freezer, or cold water, thereby cooling the fluid. In some embodiments, the fluid has a high specific heat, and therefore, warms up slowly. The cooled fluid can then either cool the contents of the food pouch, or help in keeping the contents of a pre-cooled food pouch cool. In some embodiments, the fluid is freezable.

While in some embodiments the food pouch is first inserted into the back portion 104 first and then the front portion 102 is latched to close the container 100, in other embodiments, the food pouch is first inserted into the front portion 102 first and then the back portion 104 is latched to close the container 100.

What is claimed is:

1. A food pouch container comprising:
a back portion having an interior cavity;
a front portion;
a top hole;
means for contouring a food pouch from the bottom thereof;
the means for contouring the food pouch from a bottom thereof being integral with the interior cavity of the back portion and spaced upwardly from a bottom surface of the back portion;
means for contouring a food pouch from at least a side thereof;
at least one side pinch; and
the back portion or the front portion comprises at least one curved side to create the at least one pinch.

2. The container of claim 1, wherein the back portion and the front portion are attached via a hinge.

3. The container of claim 2, wherein the hinge is at a location selected from the group consisting of a side of the container opposite of the top hole, a side of the container 90° from the top hole, and partway up from a bottom of the back portion.

4. The container of claim 1, further comprising at least one latch configured to releasably lock the front portion and the back portion together when the container is in a closed configuration.

5. The container of claim 4, wherein the latch is at a location selected from a group consisting of the bottom of the back portion, a top of the back portion, a side of the back portion, a bottom of the front portion, a top of the front portion, and a side of the front portion.

6. The container of claim 5, wherein one of the front portion or the back portion comprises a raised member while an other of the front portion or the back portion comprises an indent, wherein when the container is closed, the raised member catches the indent and causes the front portion and the back portion to remain connected.

7. The container of claim 1, wherein the means for contouring the food pouch from the bottom thereof is in a fixed position on the back portion.

8. The container of claim 1, wherein the means for contouring the food pouch from the bottom thereof is configured to be manually moved.

9. The container of claim 1, wherein the at least one side pinch is in a fixed position.

10. The container of claim 1, wherein the at least one side pinch is configured to be manually moved into or out of the interior cavity of the back portion.

11. The container of claim 1, wherein the at least one side pinch is a phantom wall.

12. The container of claim 1, wherein the container comprises at least one handle.

13. The container of claim 1, wherein an exterior cavity of the back portion is configured to receive a separated cap of a food pouch.

14. A food pouch container comprising:
a back portion having an interior cavity;
a front portion;
a top hole;
at least one side pinch;
a surface dividing the interior cavity of the back portion into an upper cavity, the upper cavity being sized and shaped to enclose at least a flexible portion of a food pouch, and a lower cavity; and
the surface is integral with the back portion, the surface being curved downwardly at outer edges thereof.

15. The container of claim 14, comprises a side pinch on each side.

16. A container for a food pouch having a flat shape for holding soft food, the pouch further having a mouthpiece portion and a removable cap for the mouthpiece, the container comprising:

a substantially rigid body configured to substantially encapsulate the pouch and sized for nesting of the pouch inside the body;

the body having an opening for the mouthpiece to protrude outside the body;

said opening being sized and shaped to fit closely about a hollow neck of a food pouch without constricting said hollow neck;

the body being contoured with an orthogonal surface integral with the rigid body and spaced upwardly from an interior bottom portion of the rigid body to change the pouch to a bulbous shape;

thereby enabling the soft food to be more easily emptied out of the pouch.

17. The container of claim 14, wherein the lower cavity is external to the body.

* * * * *